US006634457B2

(12) United States Patent
Paschereit et al.

(10) Patent No.: US 6,634,457 B2
(45) Date of Patent: Oct. 21, 2003

(54) APPARATUS FOR DAMPING ACOUSTIC VIBRATIONS IN A COMBUSTOR

(75) Inventors: Christian Oliver Paschereit, Baden (CH); Wolfgang Weisenstein, Remetschwil (CH); Peter Flohr, Baden (CH); Wolfgang Polifke, Freising (DE)

(73) Assignee: Alstom (Switzerland) Ltd, Baden (CH)

( * ) Notice: Subject to any disclaimer, the term of this patent is extended or adjusted under 35 U.S.C. 154(b) by 117 days.

(21) Appl. No.: 09/864,395

(22) Filed: May 25, 2001

(65) Prior Publication Data

US 2002/0000343 A1 Jan. 3, 2002

(30) Foreign Application Priority Data

May 26, 2000 (DE) ..... 100 26 121

(51) Int. Cl.[7] ..... F02M 35/00; F02K 1/08; F01N 7/18; F01N 1/16

(52) U.S. Cl. ..... 181/229; 181/219; 181/241; 181/277; 381/71.5

(58) Field of Search ..... 181/229, 219, 181/241, 249, 255, 271; 381/71.3, 71.5

(56) References Cited

U.S. PATENT DOCUMENTS

| | | | | |
|---|---|---|---|---|
| 3,748,852 A | | 7/1973 | Cole et al. | |
| 3,940,721 A | * | 2/1976 | Kojima et al. | 333/233 |
| 4,411,616 A | * | 10/1983 | Neumann | 181/229 |
| 5,103,931 A | | 4/1992 | Okazaki et al. | |
| 5,205,326 A | * | 4/1993 | Paley et al. | 138/30 |
| 5,283,398 A | * | 2/1994 | Kotera et al. | 181/241 |
| 5,373,695 A | | 12/1994 | Aigner et al. | |
| 5,475,189 A | * | 12/1995 | Field et al. | 181/229 |
| 6,430,933 B1 | * | 8/2002 | Keller | 60/772 |
| 6,446,454 B1 | * | 9/2002 | Lee et al. | 181/403 |

FOREIGN PATENT DOCUMENTS

| | | | | |
|---|---|---|---|---|
| DE | 3324805 A | * | 1/1985 | F23D/15/04 |
| DE | 43 16 475 | | 1/1994 | |
| DE | 44 14 232 A1 | | 10/1995 | |
| DE | 196 40 980 | | 4/1998 | |
| EP | 0 649 982 A1 | | 4/1995 | |
| EP | 974788 A1 | * | 1/2000 | F23M/13/00 |
| GB | 2 357 141 A | | 6/2001 | |
| JP | 59070868 A | * | 4/1984 | F02M/35/12 |
| JP | 61 129414 | | 6/1986 | |
| JP | 07145760 A | * | 6/1995 | F02M/35/12 |
| JP | 11 044266 | | 7/1997 | |

* cited by examiner

*Primary Examiner*—Robert E. Nappi
*Assistant Examiner*—Edgardo San Martin
(74) *Attorney, Agent, or Firm*—Burns, Doane, Swecker & Mathis, L.L.P.

(57) ABSTRACT

An apparatus for damping acoustic vibrations in a combustor as well as a corresponding combustor arrangement with the apparatus. The apparatus includes a Helmholtz resonator (4) that can be connected via a connecting channel (2) with a combustor (1). The Helmholtz resonator (4) contains a hollow body (6) the volume of which can be changed by adding or draining a fluid via a supply line (5), or is located adjacent to such a hollow body in such a way that the resonance volume (3) of the Helmholtz resonator (4) is changed when the volume of the hollow body (6) is changed. This apparatus makes it possible to adjust the resonance frequency of a Helmholtz resonator arranged inside a pressure container in accordance with the respective current operating point of the combustor to be damped, without having to pass movable components through the pressure container.

24 Claims, 1 Drawing Sheet

APPARATUS FOR DAMPING ACOUSTIC VIBRATIONS IN A COMBUSTOR

This application claims priority under 35 U.S.C. §§119 and/or 365 to Appln. No. 100 26 121.3 filed in Germany on May 26, 2000; the entire content of which is hereby incorporated by reference.

FIELD OF APPLICATION

The present invention relates to an apparatus for damping acoustic vibrations in a combustor, as well as a combustor arrangement, in particular of a gas or steam turbine, that contains the apparatus.

The main field of application of the present invention is the field of industrial gas turbines. Worldwide, increasingly higher requirements with respect to readiness, life span, and waste gas quality are placed on industrial gas turbines, especially when used in power plants. An increasing consciousness of environmental protection and environmental compatibility requires compliance with the lowest possible values for noxious emissions.

Low emissions can only be achieved economically in industrial gas turbines by using premix burners. However, in closed combustors, because of the creation of coherent structures and resulting variable release of heat, this type of combustion tends to generate thermoacoustic vibrations in the combustor. These thermoacoustic vibrations do not only adversely affect the combustion quality, but also may drastically reduce the life span of the highly stressed components.

STATE OF THE ART

The principle of the so-called Helmholtz resonator has been used for a long time to dampen such thermoacoustic vibrations. This principle is explained in more detail below in reference to FIG. 1. The figure shows the principal structure of a Helmholtz resonator 4 comprising a resonance volume 3 and a connecting channel 2 to chamber 1, in which the thermoacoustic vibrations are occurring. Such an apparatus can be seen as analogous to a mechanical spring/mass system. The volume V of the Helmholtz resonator 4 hereby acts as a spring, and the gas present in the connecting channel 2 acts as the mass. The resonance frequency f0 of the system can be calculated using the volume dimensions: whereby:

V=volume of Helmholtz resonator 4

R=radius of connecting channel 2 l=length of connecting channel 2

S=area of opening through which stimulation occurs

At this resonance frequency f0, a Helmholtz resonator behaves acoustically as an opening of infinite size, i.e., it prevents the creation of a standing wave at this frequency.

This technique of damping thermoacoustic vibrations with a Helmholtz resonator is also already used to dampen the vibrations in combustors of gas or steam turbines. However, when used in gas or steam turbines, the problem occurs that the frequency to be damped is not determined by intermittent combustion but by fulfilling the Rayleigh criterion in the combustor and by the acoustic response of the surrounding system comprising the supply line, burner, combustor, and acoustic terminus.

In these systems, the frequency to be damped therefore cannot be predetermined with the required accuracy by using the mathematical tools currently available. But this predetermination is the precondition for being able to take into consideration the exact dimensions of the resonance volume when building the gas turbine. Furthermore, the acoustical behavior of the system and thus the frequencies of the vibrations to be damped may critically change when the operating point is changed, so that it may become necessary to use additional resonators that are adapted to additional frequencies.

Such an arrangement with several Helmholtz resonators is described, for example, in DE 33 24 805 A1. This document concerns an apparatus for preventing pressure vibrations in combustors, in which apparatus several Helmholtz resonators with different resonance volumes are arranged along the gas conduit path towards the burner. The different resonator volumes in this system are able to dampen vibrations with different frequencies. However, here again the optimal sizing of the various Helmholtz resonators requires knowledge regarding the frequencies occurring during the operation of the system, where again exact frequencies cannot be provided when the system is being built. Furthermore, the arrangement of several Helmholtz resonators is disadvantageous due to the additional space needed for this purpose.

DE 196 40 980 A1 describes another known apparatus for damping thermoacoustic vibrations in a combustor. In this apparatus, the side wall of the resonance volume of the Helmholtz resonator is constructed as a mechanical spring. An additional mass has been secured to the wall of the front face of the resonance volume, said wall vibrating due to the action of the spring. This arrangement influences the virtual volume of the Helmholtz resonator and achieves greater damping power. By changing the mechanical mass at the resonator, a fine-tuning to the resonance frequency can be performed at a later time. This also requires a subsequent modification of the construction of the gas turbine system.

In the past, Helmholtz resonators were also used for damping vibrations in the field of exhaust gas systems of combustion engines. From this field, the use of adjustable resonators for changing the resonance frequencies is known. Even during World War I, for example, the two-cycle diesel engines for the Maybach company's Zeppelin dirigible were adjusted to the necessary operating point with adjustable resonators located in the exhaust pipe. For this purpose, mechanical gears moved cylinders inside each other and in this way changed the resonance volume. In said exhaust systems, this technology was found to be practical because of the good accessibility of these systems and the relatively low pressure and temperature ratio present there. But such a solution is completely unsuitable for use in the pressure range found in modern industrial gas turbines. The passing of a mechanical gear through the pressure container of a gas turbine would inevitably cause leaks and result in intolerable losses. The temperature influences associated with industrial gas turbines also could only be compensated for with a very complex gear.

The present invention describes an apparatus for damping thermoacoustic vibrations as well as a combustor arrangement comprising this apparatus that enables continuous adaptation to the frequencies of the vibrations to be damped even under high pressure conditions as occur, for example, in gas turbines.

DESCRIPTION OF THE INVENTION

The apparatus includes a Helmholtz resonator with a connecting channel that is connected to the combustor, for example, the combustor of a gas turbine. In contrast to the known damping devices, the present apparatus is provided with a hollow body, the volume of which can be changed by adding or draining a fluid via a supply line, and which is arranged either within the Helmholtz resonator or is located adjacent to it in such a way that the resonance volume of the Helmholtz resonator changes when the volume of the hollow body changes.

When the adjustable-volume hollow body is located in the Helmholtz resonator, the resonance volume decreases when the hollow body is inflated via the supply line, for example with a gas. Correspondingly, the resonance volume of the Helmholtz resonator increases, when a certain amount of the gas is drained from the hollow body. The change in resonance volume in the known manner causes a change in the resonance frequency.

In this way, the resonance frequency of the Helmholtz resonator can be adapted at any time to the thermoacoustic vibration frequencies occurring in the chamber volume by a simple inflation or deflation of the hollow body. For this reason, an exact knowledge of the frequencies occurring during operation is no longer necessary when the system is built. The vibrations can be damped by means of a broad spectrum of individually set frequencies. In practical use, the resonance frequency of the built-in resonators can be changed at any time during the operation of the system in accordance with the current operating point by changing the resonance volume.

As a special advantage, the resonance volume of the Helmholtz resonator that is usually located inside the pressure container of the gas turbine can be changed without movable parts having to be passed through the wall of the pressure container. The supply line to the hollow body can be constructed as a rigid body and therefore can be easily passed through the pressure container to the outside with a high degree of tightness.

In another embodiment of the present invention, the Helmholtz resonator is provided with a variable-position wall, next to which the hollow body is located. The variable-position wall is pressed against the hollow body by a spring mechanism. In this way, the variable-position wall is pressed inward against the spring force when the hollow body is inflated and in this way reduces the resonance volume of the Helmholtz resonator. In the reverse case, the draining of gas from the hollow body causes the resonance volume to increase because the wall is shifted due to the spring force acting in the direction of the hollow body. The Helmholtz resonator hereby can be constructed in the form of a bellows, as is known from DE 196 40 980 A1, mentioned above. Naturally, it should be understood that other designs of the Helmholtz resonator are possible to achieve the effect described above.

In this embodiment, the variable-volume hollow body must be fixed at a point relative to the Helmholtz resonator within the pressure container in order to exert the corresponding counter-force onto the variable-position wall of the Helmholtz resonator.

The variable-volume hollow body is preferably constructed as an inflatable, temperature-resistant balloon or inflatable metal bellows. The supply line to the hollow body can be flexible or rigid.

In a preferred embodiment, the gas supply to the hollow body or the draining of gas from the hollow body is performed automatically by a regulator provided outside the pressure container on the supply line. This regulator changes the resonance volume of the Helmholtz resonator as a function of the highest amplitude frequency of the thermoacoustic vibrations occurring in the combustor by blowing the gas into the hollow body or draining it out. The respective vibration amplitudes and vibration frequencies are hereby measured with a suitable sensor, as known to one skilled in the art. The regulator preferably controls the resonance volume or volume of the hollow body by adding or draining compressor air received from the compressor outlet of the gas turbine. This makes it possible to achieve an optimum vibration damping at any time during the operation of the gas turbine, since the regulator is able to adapt the resonance volume at any time exactly to the currently occurring frequencies.

BRIEF DESCRIPTION OF THE DRAWINGS

The present apparatus or combustor arrangement is again briefly explained below with the help of exemplary embodiments in reference to the figures. In the drawing.

WAYS TO REALIZE THE INVENTION

Figure 1:
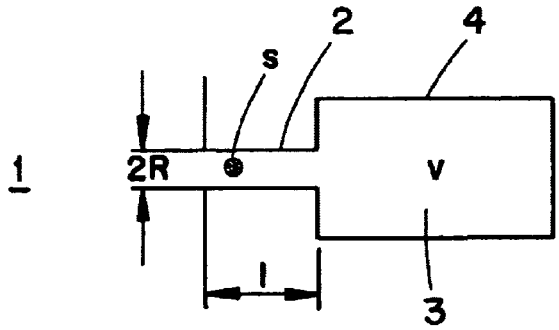
Fig. 1 PRIOR ART
FIG. 1 shows the basic construction of a Helmholtz resonator.

FIG. 1 shows the basic construction of a Helmholtz resonator 4 with the resonance volume 3 and a connecting channel 2 as it is known from the state of the art. Details of this were already described in the introductory description.

Figure 2:
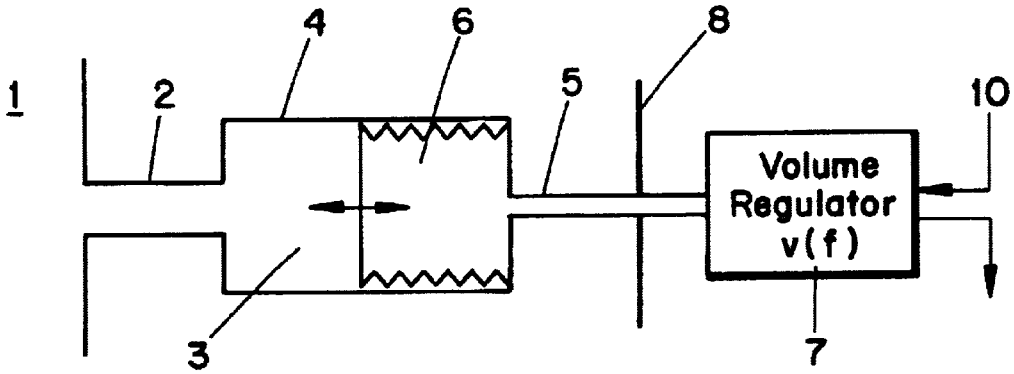
FIG. 2 shows a first exemplary embodiment of the construction of the present apparatus.

FIG. 2 shows a first exemplary embodiment of an apparatus according to the invention in a combustor 1 of a gas turbine. This figure shows the adjustable Helmholtz resonator 4 that is connected via a connecting channel 2 with the combustor 1. A hollow body 6 whose volume can be changed by adding or draining gas via a supply line 5 is located inside the Helmholtz resonator 4. The hollow body 6 in this example includes a metal bellows that is inflated with air 10 from the compressor outlet of the gas turbine or is deflated by a draining of this air. For this purpose, the interior of the Helmholtz resonator 4, the so-called resonance volume 3, that is filled with combustion gases is enlarged or reduced based on a center position, as is indicated in the figure by an arrow. The inflation and deflation of the bellows 6 is controlled via a corresponding regulator 7 that adjusts the volume in relation to the respective thermoacoustic vibration frequencies to be damped. The construction of the hollow body 6 as a metal bellows is especially suitable for use under high temperatures.

The supply line 5 to the bellows 6 leads through the pressure container 8 of the gas turbine. This passage through the pressure container 8 can be well sealed, since it does not contain any movable components. The present apparatus therefore makes it possible to change the resonance volume 3 of the Helmholtz resonator 4 mounted inside the pressure container 8 from the outside of said pressure container without an increased risk of leakage of the pressure container 8.

The resonance frequency of the adjustable Helmholtz resonator 4 is influenced decisively not only by the size of the resonance volume 3 and the length of the connecting channel 2 to the combustor 1, but also by the length of the supply line 5 to the regulator 7 and the temperature of the control air, i.e., the gas used for inflating the hollow body 6. The relationships are, however, relatively complex. As a guideline, it can be stated that the frequency range that can be regulated with the apparatus is increased with an increasing temperature differential of the gases—combustion air in the resonance volume 3 and control air in the hollow body 6—used in the Helmholtz resonator 4. By suitably selecting or adjusting the temperature of the control air used for inflating the hollow body 6, this frequency range therefore can be increased.

The adaptation of the resonance volume 3 is accomplished via the automatic regulator 7 that, as already mentioned, increases or reduces the bellows 6 depending on the frequency level of the highest vibration amplitude in the combustor. Since the level of this amplitude on the frequency axis changes only within a relatively small band during the operation of the burner, no particularly rapid control is necessary for achieving optimum adaptation.

Figure 3:
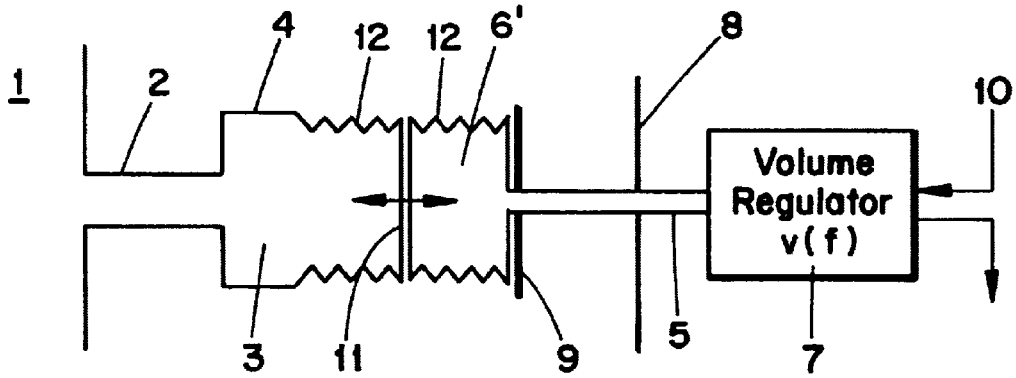
FIG. 3 shows a second exemplary embodiment of the construction of the present apparatus.

FIG. 3 finally shows another example for a possible embodiment of the apparatus according to the invention. In this example, the hollow body 6' is not arranged inside the Helmholtz resonator 4 but rather is located adjacent to a variable-position wall 11 of said resonator 4. The function principle is the same as was already explained in reference to FIG. 2. In this embodiment, the Helmholtz resonator 4, like the hollow body 6', is constructed—at least in part—as a bellows, whereby a frontal face of the Helmholtz resonator 4 is located adjacent to a frontal face of the hollow body 6'. The opposing frontal face of the hollow body 6' is fixed at a corresponding anchor 9 in the pressure container 8.

If the hollow body 6' in this embodiment is inflated via supply line 5 and regulator 7, the variable-position wall 11 of the Helmholtz resonator 4 shifts to the left in the figure, reducing the resonance volume 3. In the reverse case, a shift to the right occurs, increasing the resonance volume 3. However, this shift requires that a spring mechanism press the variable-position wall 11 of the Helmholtz resonator 4 against the hollow body 6'. This spring mechanism can be achieved, for example, with an elastic construction of the wall material 12 of the bellows. Alternatively, a spring may be provided within the Helmholtz resonator 4 for this purpose.

List of Reference Numbers

1 Combustor
2 Connecting channel
3 Resonance volume
4 Helmholtz resonator
5 Supply line
6 Hollow body; bellows
7 Regulator
8 Pressure container
9 Anchor
10 Air from compressor outlet
11 Variable-position wall

What is claimed is:

1. Apparatus for damping acoustic vibrations in a combustor, comprising:

a Helmholtz resonator having a resonance volume and a connecting channel through which the combustor can be connected with the resonance volume, a hollow body having a volume and a fluid supply line in fluid communication with the volume, the hollow body being configured and arranged to change the hollow body volume by adding or draining a fluid via the supply line, the hollow body being located at a position selected from the group consisting of (a) in the Helmholtz resonator and (b) adjacent to the Helmholtz resonator;

wherein the resonance volume of the Helmholtz resonator is changed when the volume of the hollow body is changed; and a regulator in fluid communication with the supply line, the regulator regulating the addition or draining of the fluid via the supply line as a function of the frequency of a highest vibration amplitude in the combustor.

2. Apparatus as claimed in claim 1, wherein the body comprises an inflatable, temperature-resistant balloon.

3. Apparatus as claimed in claim 1, wherein the hollow body comprises an inflatable metal bellows.

4. Apparatus as claimed in claim 1, wherein the hollow body is located in the Helmholtz resonator, the Helmholtz resonator comprises a wall including a passage therethrough, and the supply line extends through the passage in the Helmholtz resonator wall.

5. Apparatus as claimed in claim 1, wherein the Helmholtz resonator further comprises:

at least one variable-position wall adjacent to which the hollow body is located; and a spring mechanism which presses the variable-position wall against the hollow body.

6. A system comprising:

a turbine having a pressure container, the pressure container having a wall;

a combustor; and an apparatus for damping acoustic vibrations in the combustor, the apparatus including:

a Helmholtz resonator having a resonance volume and a connecting channel through which the combustor can be connected with the resonance volume, and a hollow body having a volume and a fluid supply line in fluid communication with the volume, the hollow body being configured and arranged to change the hollow body volume by adding or draining a fluid via the supply line, the hollow body being located in the Helmholtz resonator or adjacent to the Helmholtz resonator, and a regulator in fluid communication with the supply line, the regulator regulating the addition or draining of the fluid via the supply line as a function of the frequency of a highest vibration amplitude in the combustor, wherein the resonance volume of the Helmholtz resonator is changed when the volume of the hollow body is changed;

wherein the Helmholtz resonator and the combustor are arranged inside the pressure container, and wherein the supply line to the hollow body passes outwardly through the pressure container wall.

7. A system comprising:

a turbine having a pressure container, the pressure container having a wall;

a combustor, and an apparatus for damping acoustic vibrations in the combustor, the apparatus including:

a Helmholtz resonator having a resonance volume and a connecting channel through which the combustor can be connected with the resonance volume, and a hollow body having a volume and a fluid supply line in fluid communication with the volume, the hollow body being configured and arranged to change the hollow body volume by adding or draining air from the turbine via the supply line, the hollow body being located in the Helmholtz resonator or adjacent to the Helmholtz resonator, wherein the resonance volume of the Helmholtz resonator is changed when the volume of the hollow body is changed;

wherein the Helmholtz resonator and the combustor are arranged inside the pressure container, and wherein the supply line to the hollow body passes outwardly through the pressure container wall, wherein the hollow body is supplied with air from the turbine.

8. A system as claimed in claim 6, wherein the turbine is a gas turbine.

9. A system as claimed in claim 6, wherein the turbine is a steam turbine.

10. A method of damping acoustic vibrations in a combustor comprising the steps of:

providing a Helmholtz resonator in fluid communication with the combustor;

providing a hollow body, the hollow body being configured and arranged to change the hollow body volume by adding or draining a fluid via a supply line; and supplying a fluid to the hollow body to change the hollow body volume, the change in the hollow body volume changing the resonance volume of the Helmholtz resonator, wherein the combustor has a highest vibration amplitude at a frequency and further comprising the step of:

regulating the step of supplying the fluid to the hollow body as a function of the frequency of a highest vibration amplitude in the combustor.

11. A method in accordance with claim 10, wherein the step of providing a hollow body comprises providing a hollow body located at a position selected from the group consisting of (a) in the Helmholtz resonator and (b) adjacent to the Helmholtz resonator.

12. A method in accordance with claim 11, wherein the Helmholtz resonator includes at least one variable-position wall adjacent to which the hollow body is located, and further comprising:

pressing the Helmholtz resonator variable-position wall against the hollow body.

13. A method in accordance with claim 12, wherein the step of pressing the Helmholtz resonator variable-position wall against the hollow body comprises pressing with a spring.

14. A method in accordance with claim 10, wherein the step of supplying a fluid to the hollow body comprises supplying air from a turbine.

15. A method in accordance with claim 14, wherein the step of supplying a fluid from a turbine comprises supplying fluid from a gas turbine.

16. A method in accordance with claim 10, wherein the step of supplying a fluid to the hollow body comprises supplying fluid from a steam turbine plant.

17. A method in accordance with claim 16, wherein the fluid is compressed air.

18. Apparatus for damping acoustic vibrations in a combustor, comprising:

a Helmholtz resonator having a resonance volume and a connecting channel through which the combustor can be connected with the resonance volume, a hollow body having a volume and a fluid supply line in fluid communication with the volume, the hollow body being configured and arranged to change the hollow body volume by adding or draining a fluid via the supply line, the hollow body abutting the Helmholtz resonator;

wherein the resonance volume of the Helmholtz resonator is changed when the volume of the hollow body is changed.

19. Apparatus as claimed in claim 18, wherein the body comprises an inflatable, temperature-resistant balloon.

20. Apparatus as claimed in claim 19, wherein the hollow body comprises an inflatable metal bellows.

21. Apparatus as claimed in claim 18, wherein the Helmholtz resonator further comprises:

at least one variable-position wall adjacent to which the hollow body is located; and a spring mechanism which presses the variable-position wall against the hollow body.

22. Apparatus as claimed in claim 18, further comprising a regulator in fluid communication with the supply line, the regulator regulating the addition or draining of the fluid via the supply line as a function of the frequency of a highest vibration amplitude in the combustor.

23. A method of damping acoustic vibrations in a combustor comprising the steps of:

providing a Helmholtz resonator in fluid communication with the combustor;

providing a hollow body, the hollow body abutting the Helmholtz resonator and being configured and arranged to change the hollow body volume by adding or draining a fluid via a supply line; and supplying a fluid to the hollow body to change the hollow body volume, the change in the hollow body volume changing the resonance volume of the Helmholtz resonator.

24. The method according to claim 23, further comprising regulating the step of supplying the fluid to the hollow body as a function of the frequency of a highest vibration amplitude in the combustor.

* * * * *